US008141527B2

(12) United States Patent
Schafer et al.

(10) Patent No.: US 8,141,527 B2
(45) Date of Patent: Mar. 27, 2012

(54) CAMSHAFT ADJUSTER HAVING A VARIABLE RATIO GEAR UNIT

(75) Inventors: Jens Schafer, Herzogenaurach (DE); Mike Kohrs, Wilthen (DE); Falko Arnold, Nuremberg (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 242 days.

(21) Appl. No.: 12/279,141

(22) PCT Filed: Jan. 19, 2007

(86) PCT No.: PCT/EP2007/050520

§ 371 (c)(1),
(2), (4) Date: Aug. 12, 2008

(87) PCT Pub. No.: WO2007/093479

PCT Pub. Date: Aug. 23, 2007

(65) Prior Publication Data

US 2009/0038570 A1 Feb. 12, 2009

(30) Foreign Application Priority Data

Feb. 18, 2006 (DE) ..... 10 2006 007 584

(51) Int. Cl.
*F01L 1/34* (2006.01)

(52) U.S. Cl. ..... 123/90.17; 123/90.15

(58) Field of Classification Search ..... 123/90.15, 123/90.17
See application file for complete search history.

(56) References Cited

U.S. PATENT DOCUMENTS

| | | | | |
|---|---|---|---|---|
| 4,747,375 | A * | 5/1988 | Williams | 123/90.15 |
| 5,174,253 | A * | 12/1992 | Yamazaki et al. | 123/90.17 |
| 6,199,522 | B1 | 3/2001 | Regueiro | |
| 7,143,730 | B2 * | 12/2006 | Yamanaka | 123/90.17 |
| 7,380,530 | B2 * | 6/2008 | Schafer et al. | 123/90.17 |
| 7,597,075 | B2 * | 10/2009 | Schafer et al. | 123/90.17 |
| 2003/0037741 | A1 * | 2/2003 | Kohrs | 123/90.17 |
| 2003/0226534 | A1 | 12/2003 | Watanabe et al. | |
| 2006/0207537 | A1 * | 9/2006 | Nakajima et al. | 123/90.17 |
| 2008/0047513 | A1 * | 2/2008 | Schafer et al. | 123/90.17 |

FOREIGN PATENT DOCUMENTS

| | | |
|---|---|---|
| DE | 3737602 | 5/1989 |
| DE | 3830382 | 1/1990 |
| DE | 4110195 | 10/1992 |
| DE | 19702670 | 3/1998 |

(Continued)

*Primary Examiner* — Thomas Denion
*Assistant Examiner* — Daniel Bernstein
(74) *Attorney, Agent, or Firm* — Volpe and Koenig, P.C.

(57) ABSTRACT

A camshaft adjuster (1) having a variable ratio gear unit (2). Usually, a drive movement of an electrical actuating assembly (7) is transmitted into a variable ratio gear unit (2) of a camshaft adjuster (1) on the side which faces away from the camshaft (6). According to the invention, the abovementioned drive movement is transmitted in from the side of the variable ratio gear unit (2) which faces the camshaft (6). As a result, a further assembly, for example a vacuum pump, can be driven by the variable ratio gear unit (2) on the side of the variable ratio gear unit (2) which has become free and faces away from the camshaft (6). An actuating shaft (4) of the actuating assembly (7) is preferably mounted via a bearing (34) which is supported on a circumferential face of the camshaft (6). This results in a reduced axial overall size of the camshaft adjuster and extended possibilities for the arrangement of an actuating assembly and the connection of additional assemblies.

14 Claims, 12 Drawing Sheets

FOREIGN PATENT DOCUMENTS

| | | | |
|---|---|---|---|
| DE | 10038354 | | 2/2002 |
| DE | 10054797 | | 5/2002 |
| DE | 10054796 | | 6/2002 |
| DE | 10205034 | | 8/2003 |
| DE | 10317607 | | 11/2003 |
| DE | 10224446 | | 12/2003 |
| DE | 10257706 | | 1/2004 |
| DE | 10260546 | | 7/2004 |
| DE | 10352255 | | 6/2005 |
| EP | 1043482 | | 10/2003 |
| FR | 1261797 | | 5/1961 |
| WO | 8703335 | | 6/1987 |
| WO | WO 8703335 | A1 * | 6/1987 |
| WO | 03095803 | | 11/2003 |
| WO | 03098010 | | 11/2003 |
| WO | 2004035998 | | 4/2004 |
| WO | WO 2004057163 | A1 * | 7/2004 |
| WO | 2006005406 | | 1/2006 |

* cited by examiner

CAMSHAFT ADJUSTER HAVING A VARIABLE RATIO GEAR UNIT

BACKGROUND

The invention relates to a camshaft adjuster for an internal combustion engine according to the preamble of Claim 1.

Camshaft adjusters can be classified generally as follows:

A. Phase adjuster with an actuating element, that is, a functional unit that engages in the mass flow or energy flow, which is constructed, for example, hydraulically, electrically, or mechanically, and which rotates with drive elements of the camshaft adjuster.

B. Phase adjuster with a separate actuator, that is, a functional unit, in which the actuating parameter necessary for regulating the actuating element is formed from the regulator output parameter, and a separate actuating element. Here, there are the following constructions:

a. Phase adjuster with a co-rotating actuator and a co-rotating actuating element, for example, a high ratio gear drive, whose adjustment shaft can be advanced by a co-rotating hydraulic motor or centrifugal force motor and which can be retarded by a spring.

b. Phase adjuster with a co-rotating actuating element and a stationary, motor-fixed actuator, for example, an electric motor or an electric or mechanical brake, see also DE 100 38 354 A1, DE 102 06 034 A1, EP 1 043 482 B1.

c. Phase adjuster with a directionally dependent combination of the solutions according to a. and b., for example, a motor-fixed brake, in which a portion of the brake power is used, for example, for adjusting toward an advanced position, in order to tension a spring, which enables the retarding adjustment after the brake is deactivated, see also DE 102 24 446 A1, WO 03-098010, US 2003 0226534, DE 103 17 607 A1.

In systems according to B.a. to B.c., the actuator and actuating elements are connected to each other by an actuating shaft. The connection can have a configuration that is switchable or non-switchable, detachable or non-detachable, clearance-free or burdened with clearance, and flexible or stiff. Independent of the construction, the adjustment energy can be realized by the provision of a drive and/or brake power, as well as by use of loss powers of the shaft system (e.g., friction) and/or moments of inertia and/or centrifugal forces. Braking can also take place, advantageously in the "retarded" adjustment direction, under complete use or co-use of the friction power of the camshaft. A camshaft adjuster can be equipped with or without a mechanical limit of the adjustment range. As a gear drive in a camshaft adjuster, one-stage or multiple-stage triple-shaft gear drives and/or multiple linkage or coupling gear drives are used, for example, in constructions as wobble-plate gear drives, eccentric gear drives, planetary gear drives, undulating gear drives, cam plate gear drives, multiple linkage or coupling gear drives or combinations of the individual constructions for a multiple-stage configuration.

While conventional, hydraulically actuated camshaft adjusters or camshaft adjusters in configurations with vane cells, pivot vanes, or segment vanes have the advantage that

- the hydraulic medium can be fed into the camshaft adjuster at any point for actuation,
- the hydraulic medium is fed further into the camshaft adjuster via suitable flow channels,
- the hydraulic medium—if necessary—can be reversed, and
- suitable devices for actuating the hydraulic pressure can also be arranged eccentric to the camshaft adjuster, in conventional camshaft adjusters, in which the actuating movement is generated by an electric motor and a variable ratio gear drive, triple-shaft gear drive, or planetary gear drive (in the following, variable ratio gear drive), see, e.g., DE 41 10 195 A1, the electric motor is typically arranged before the variable ratio gear drive aligned with the longitudinal axis of the camshaft and the variable ratio gear drive. For this reason, such camshaft adjusters with an electrical actuating assembly and a variable ratio gear drive are built axially larger than corresponding hydraulically actuated camshaft adjusters.

From DE 37 37 602 A1, it is known to use a differential gear drive as a variable ratio gear drive, in which drive is realized by means of a drive wheel in drive connection with the crankshaft and a driven part to the camshaft aligned with the longitudinal axis, while the feeding of the drive movement of the electrical actuating assembly is realized radial to the previously mentioned longitudinal axis.

From DE 102 60 546 A1, a hydraulic camshaft adjuster is known, to which a vacuum pump can be coupled on the side facing away from the camshaft aligned with the longitudinal axis.

DE 38 30 382 C1 discloses the drive of a planetary gear drive mounted axially before a variable ratio gear drive using an electrical actuating assembly, whose longitudinal axis is offset parallel to the longitudinal axis of the camshaft and the variable ratio gear drive.

The variable ratio gear drive known from U.S. Pat. No. 4,747,375 is constructed as a planetary gear drive, in which, for a first construction, the ring gear is driven by a servomotor, whose longitudinal axis is arranged parallel to the longitudinal axis of the camshaft, while the sun wheel of the planetary gear drive is in drive connection with the crankshaft of the internal combustion engine and the planetary gear drive is driven relative to the camshaft by a connecting piece. For an alternative construction, the drive is realized using the servomotor and the sun wheel for an aligned orientation of the servomotor relative to the longitudinal axis of the camshaft, while the crankshaft drives the ring gear by driving the connecting piece of the planetary gear drive.

Finally, DE 103 52 255 A1 discloses a coupling of an electrical actuating assembly via a flexible shaft, a pneumatic motor, a hydromotor, so that the actuating assembly can be arranged at any point. Furthermore, from the publication the proposal is to be taken to arrange an electrical actuating assembly parallel to the camshaft and to arrange a gear stage between the variable ratio gear drive and the electrical actuating assembly.

SUMMARY

The present invention is based on the objective of providing a camshaft adjuster, which offers expanded possibilities for integration of the same in an internal combustion engine. In particular, the invention is based on the objective of allowing a drive of an additional assembly via the camshaft adjuster.

According to the invention, this objective is met by the features of the independent Claim 1. Additional constructions of the invention emerge accordingly from the features of the dependent Claims 2 to 10.

According to the invention, the feeding of the drive movement of the actuating assembly into the variable ratio gear drive does not take place on the "free end" of the variable ratio gear drive, that is, on the side facing away from the camshaft, but instead on the side facing the camshaft. Here, the invention has recognized that an installation space typically provided on the side of the camshaft adjuster facing the camshaft for hydraulically actuated camshaft adjusters is not used for camshaft adjusters with an electrical actuating assembly and variable ratio gear drive. Thus, this installation space can be used according to the invention. This can be the case, on one hand, when the same internal combustion engine is to be used, on one side, with a hydraulic camshaft adjuster and, on the other side, in a variant with a camshaft adjuster with an actuating assembly and a variable ratio gear drive. On the other hand, such a construction is also possible for a total construction series of internal combustion engines with actuating assemblies. Here, only the shaft feeding the power to the variable ratio gear drive can be arranged on the side of the variable ratio gear drive facing the camshaft or also the entire actuating assembly with an allocated actuating shaft. The free installation space for hydraulic systems is produced, in particular, due to the elimination of transmission elements for a hydraulic medium and associated actuating valves.

Due to the elimination of the feeding of the drive movement on the side of the variable ratio gear drive facing away from the camshaft, free installation space is produced on this side, which can be used for this purpose according to another construction of the invention, such that, on this side, a shaft is guided out, by which an additional assembly, in particular, a vacuum pump, a fuel-injection pump, or an ignition distributor, can be driven. In this way, the shaft can be arranged aligned or parallel to the longitudinal axis of the camshaft and the camshaft adjuster. The shaft guided out of the variable ratio gear drive on the side facing away from the camshaft can be coupled, in terms of driving, with any of the three gear drive elements of the variable ratio gear drive, in particular, with a sun, a connecting piece, or a ring gear for the case that the variable ratio gear drive is constructed as a planet set.

Through the construction according to the invention, deviating from a connection of a camshaft, a variable ratio gear drive, and an electrical actuating assembly one after the other in the previously mentioned sequence, axial installation space can be saved, wherein the savings can equal up to the axial installation length of the actuating assembly including an allocated actuating shaft. Furthermore, for the previously mentioned connection of camshaft, variable ratio gear drive, and actuating assembly one after the other, the support of the actuating assembly—next to an already present wall of the cylinder head, in the region of which the camshaft is supported and/or hydraulic medium for a hydraulic camshaft adjuster is guided—an additional cylinder head-fixed support wall or a corresponding carrier is required, which, nevertheless has guaranteed the accessibility of the drive wheel of the camshaft adjuster for the traction element of the actuating drive, e.g., by a suitable opening. Such an additional wall can be spared according to the invention, so that the camshaft adjuster can be arranged freely accessibly on the outer side of the cylinder head.

The actuating assembly can have an arbitrary construction, for example, as an electric drive assembly or as a hydromotor, and it can act as a drive unit and/or as a brake.

Corresponding to another aspect of the invention, the actuating assembly is integrated into an end face of the cylinder head, by which an especially compact construction is produced for a simultaneously good support of the actuating assembly.

Advantageously, the actuating assembly is arranged adjacent to a first camshaft bearing, where installation space not used from prior applications with hydraulic camshaft adjusters can be utilized.

An especially compact construction of the invention is produced when the camshaft is guided through the actuating assembly. In this way, free installation space present radially in the surroundings of the camshaft can be used for the actuating assembly. Advantageously, components, in particular, an actuating shaft and an allocated rotor of the actuating assembly are constructed as hollow bodies or hollow shafts, through which the camshaft or connection elements between the camshaft and the gear element allocated to the camshaft are guided.

According to another feature of the invention, components of the actuating assembly, in particular, the previously mentioned actuating shaft and a rotor of an actuating assembly allocated to this actuating shaft are supported relative to the camshaft. For example, a roller bearing can be supported on the inside in the radial direction on an inner peripheral surface of the rotor or actuating shaft. Under some circumstances, the entire camshaft adjuster is supported by such a bearing and only one stator of the actuating assembly is supported with its housing, for example, on a cylinder head. A bearing of the rotor and actuating shaft of the actuating assembly on the camshaft has the result that no relative movement is generated in the bearing, as long as the camshaft adjuster is not adjusted. This is advantageous in terms of the thermal and mechanical loading of the bearing.

For another construction of the camshaft adjuster according to the invention, both the rotor of the actuating assembly and also the stator of the actuating assembly are supported by an end cylinder head wall. This can lead to the result that the actuating assembly can be completely sealed, so that no lubricant can enter into the actuating assembly from the internal combustion engine. In this case, permanent lubrication of the bearing provided in the actuating assembly can be used. Furthermore, the rotor can be supported by a roller bearing against the stator, which is supported, in turn, on the end cylinder head wall. Such a construction has the advantage that bearing inaccuracies or production tolerances, for example, between the cylinder head and camshaft or other components, cannot negatively affect the function of the actuating assembly. On the other hand, in such a case, the use of bearings with an enlarged diameter can be necessary, by which the number of roller bodies and the mass of the rotating parts can increase and an enlarged friction radius of the bearing is produced.

As an advantageous coupling of the actuating assembly and the allocated gear element, a polygonal-shaft-hub connection is produced, for example, a polygon P4C or polygon P3G shaft hub connection, which can be constructed, in particular, according to the standards DIN 32711 and DIN 32712 and the corresponding constructions and modifications available on the market. Such connections can lead to the following advantages:

easy assembly and disassembly, low stress peaks due to a rounded convex profile shape, high load carrying capacities relative to other positive-fit shaft-hub connections, accurate-fit production of also hardened connection partners through grinding, self-centering and torsion load for a P3G profile, equal thickness character for P3G profile and good axial displacement under torsion load for a P4C profile, longitudinal displacement of the P4C profile under torque moment, grindability of the hub profile P3G.

Alternatively or additionally, vulcanization of a compensation element between the actuating shaft, actuating element, gear element, and actuating assembly is also possible.

Also possible is the use of a magnet coupling with or without an air gap, for which the motor also can have a closed construction and which can allow sliding in the region of the magnet coupling.

Corresponding to a refinement of the camshaft adjuster according to the invention, a longitudinal axis of the actuating assembly, in particular, the longitudinal axis of the drive shaft of the actuating assembly, can be oriented parallel to the camshaft. In this way, the installation space required for the actuating assembly can be mounted even farther away from the camshaft. It is also possible to connect a gear stage, for example, a spur wheel stage, by which the rotational speed ratios and the moments generated in the actuating assembly can be suitably converted, between the actuating assembly and the gear element of the variable ratio gear drive.

Advantageous improvements of the invention emerge from the patent claims, the description, and the drawings. The advantages of features and combinations of several features named in the introduction of the description are merely examples, and these do not necessarily have to be the goal of embodiments according to the invention. Additional features are to be taken from the drawings—in particular, the illustrated geometries and the relative dimensions of several components relative to each other and also their relative arrangement and active connection. The combination of features of different embodiments of the invention or of features of different claims is also possible deviating from the selected associations of claims and is herewith suggested. This also relates to features, which are shown in separate drawings or named in the description of these drawings. These features can also be combined with features of different claims. Likewise, features listed in the claims can be left out of other embodiments of the invention.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

In the figures, components that correspond in terms of their shape and/or function are provided generally with the same reference symbols.

Figure 1:
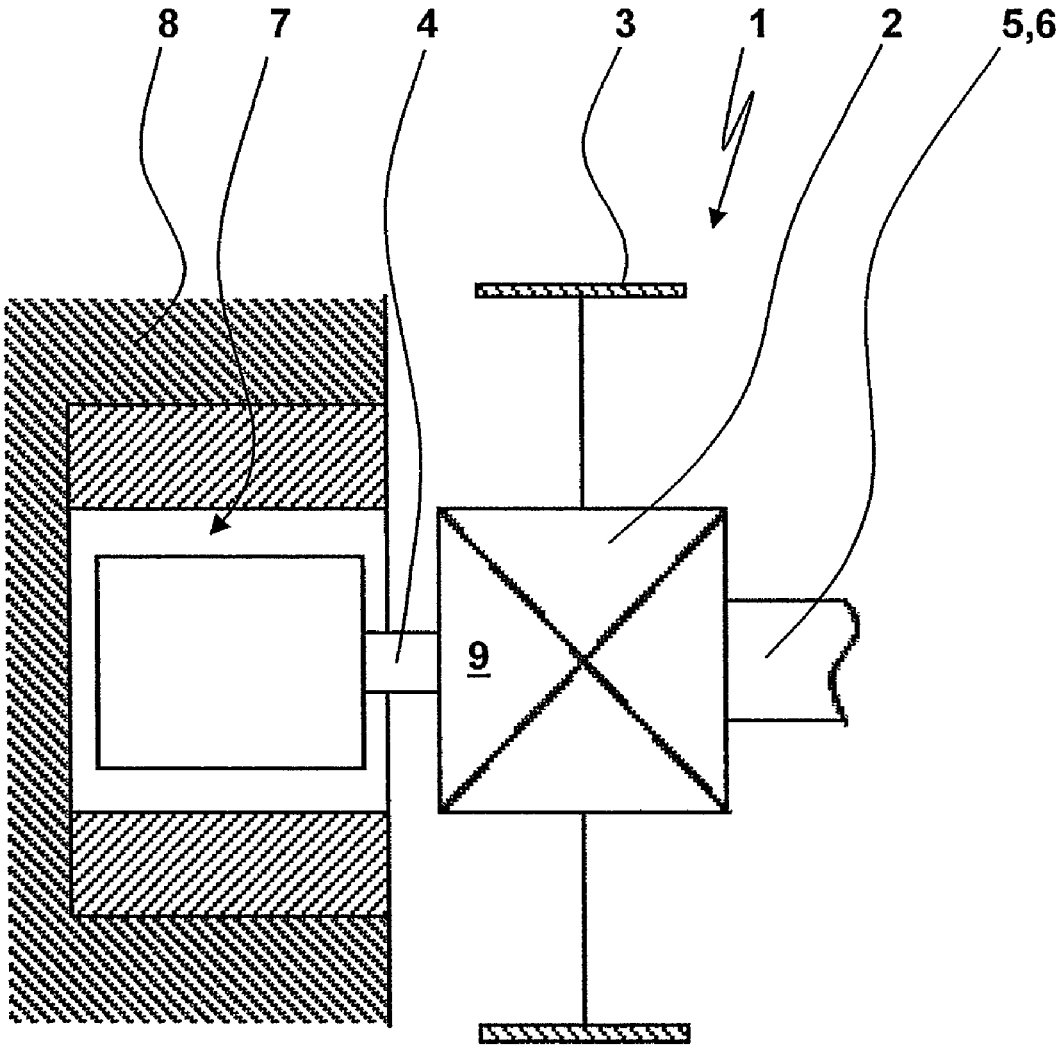
Fig. 1 (Prior Art)
FIG. 1 is a schematic representation of a camshaft adjuster according to the state of the art, in which an electrical actuating assembly is arranged on the side of a variable ratio gear drive facing away from the camshaft.

FIG. 1 shows, in schematic representation, a camshaft adjuster 1, in which, in a variable ratio gear drive 2, the movement of two input elements, here a drive wheel 3 and an actuating shaft 4, is converted into an output movement of an output element, here, a driven shaft 5 locked in rotation with a camshaft or the camshaft 6 directly. The drive wheel 3 is in driven connection with a crankshaft of the internal combustion engine, for example, by a traction mechanism, such as a chain or a belt or suitable gearing, wherein the drive wheel 3 can be constructed as a chain or belt wheel.

The actuating shaft 4 is driven by an electrical actuating assembly 7 or is in active connection with a brake. The electrical actuating assembly 7 is supported relative to the surroundings, for example, the cylinder head 8 or another motor-fixed part.

Figure 2:
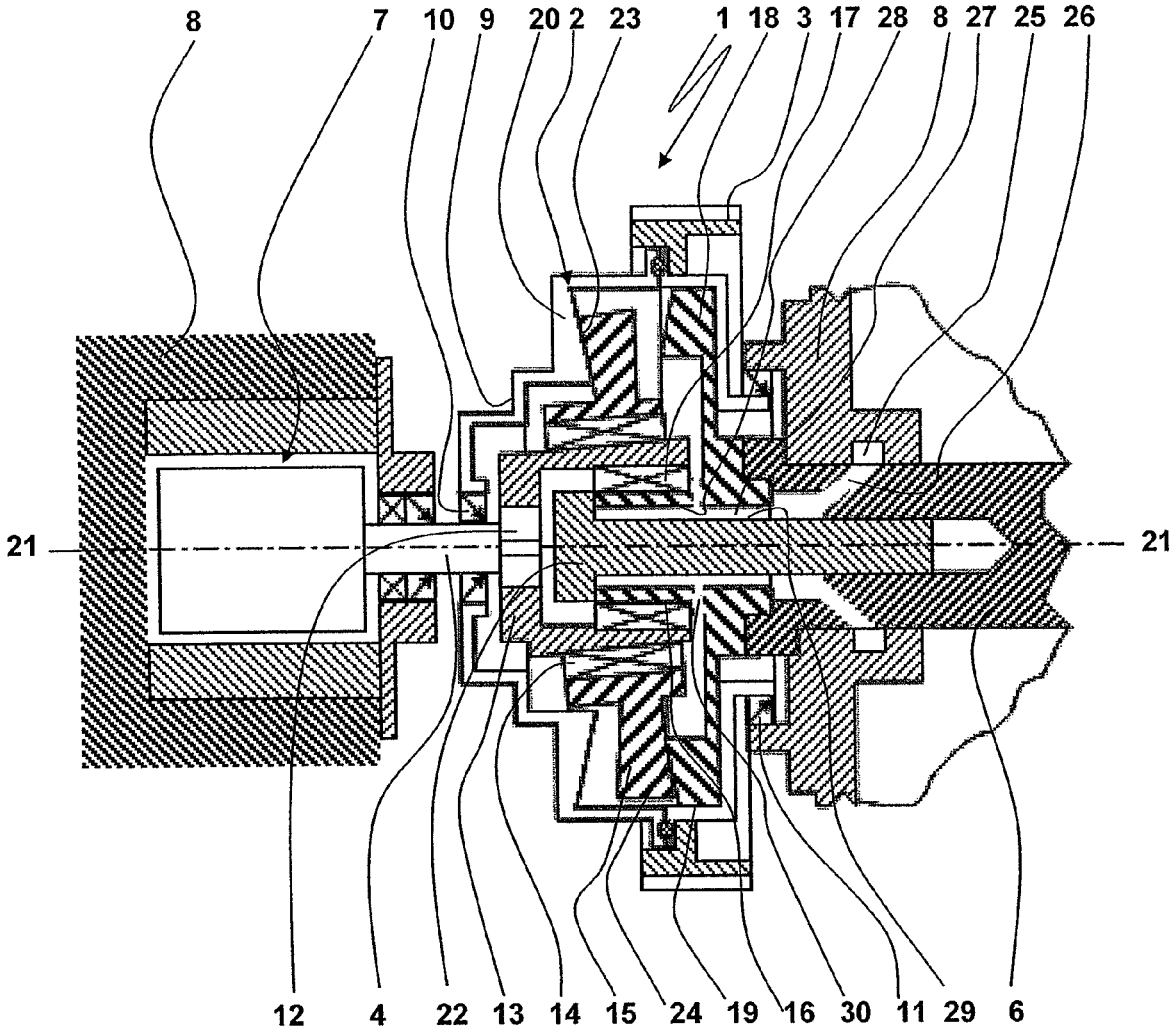
Fig. 2 (Prior Art)
FIG. 2 is a view of an exemplary construction of a camshaft adjuster with a wobble-plate gear drive according to the state of the art.

FIG. 2 shows an example construction of a camshaft adjuster 1 with a variable ratio gear drive 2 in a wobble plate construction. A housing 9 is locked in rotation with the drive wheel 3 and is sealed in an axial end region against the actuating shaft 4 by a sealing element 10. In the opposite axial end region, the housing 9 is sealed against the cylinder head 8 with a sealing element 11. An end region of the camshaft 6 projects in an interior space formed by the housing 9 and the cylinder head 8. Furthermore, in the interior space there is an eccentric shaft 13 connected via a coupling 12 to the actuating shaft 4, a wobble plate 15 supported by a bearing element 14, for example, a roller bearing, and a hollow shaft 16, which is supported by a bearing element 17, for example, a roller bearing, on the inside in a central recess of the eccentric shaft 13 and carries a driven conical wheel 18. The driven conical wheel 18 is supported on the housing 9 by a bearing 19. In the interior, the housing 9 forms a driven conical wheel 20. The wobble plate 15 has suitable toothing on opposing ends. The eccentric shaft 13 rotates with the bearing element 14 about an axis inclined relative to a longitudinal axis 21-21, so that the wobble plate meshes on partial regions offset relative to each other in the peripheral direction, on one side, with the driven conical wheel 20 and, on the other side, with the driven conical wheel 18, wherein up-conversion or down-conversion is given between the drive conical wheel and the driven conical wheel. The driven conical wheel 18 is locked in rotation with the camshaft 6.

For the embodiment shown in FIG. 2, the hollow shaft 16 is screwed on the end with the camshaft 6 with the driven conical wheel 18 by a central screw 22, which extends through the hollow shaft 16. Lubrication is necessary with a lubricant, especially oil, in the region of lubricant positions 23, 24, in which it can involve, for example, the contact surfaces between drive conical wheel 20 and wobble plate 15, the contact surface between wobble plate 15 and driven conical wheel 18, the bearing 19, bearing element 14, and/or bearing element 17.

For this purpose, lubricant is supplied and/or forwarded in a continuous, cyclic, pulsating, or intermittent way via lubricant channels. Via a supply recess 25 of the cylinder head 8, the lubricant is fed to a flow channel 26 of the camshaft 6, which communicates with a flow channel 27, which has a hollow cylinder shape between an inner peripheral surface 28 of the hollow shaft 16 and an outer peripheral surface 29 of the central screw 22. Through the use of radial boreholes 30 of the hollow shaft 16, the lubricant can be discharged out of the flow channel 27 outward in the radial direction and fed to the lubricating positions.

The variable ratio gear drive 2 shown in FIG. 2 in the form of a wobble plate gear drive is merely one example construction of such a variable ratio gear drive 2. In FIGS. 3 to 12, the variable ratio gear drive 2 is shown merely schematically, wherein this variable ratio gear drive 2 can involve a gear drive with a wobble plate construction according to FIG. 2 or some other variable ratio gear drive, such as the camshaft adjusters, planetary gear drives, or triple-shaft gear drives classified above. For the case of a construction as a planetary gear drive, the gear elements carrying out the conversion involve a sun wheel, planets mounted on a connecting piece, and also a ring gear.

For example, the actuating assembly 7 is connected via the actuating shaft 4 to the connecting piece, the ring gear is connected to the drive wheel 3, and the sun wheel is connected to the camshaft 6.

In an alternative construction, the gear elements carrying out the conversion involve, for example, an axial moving actuating element, which is acted upon by the actuating assembly and which interacts with a drive wheel-fixed threading and a camshaft-fixed threading, cf., e.g., EP 1 403 470 A1.

Figure 3:
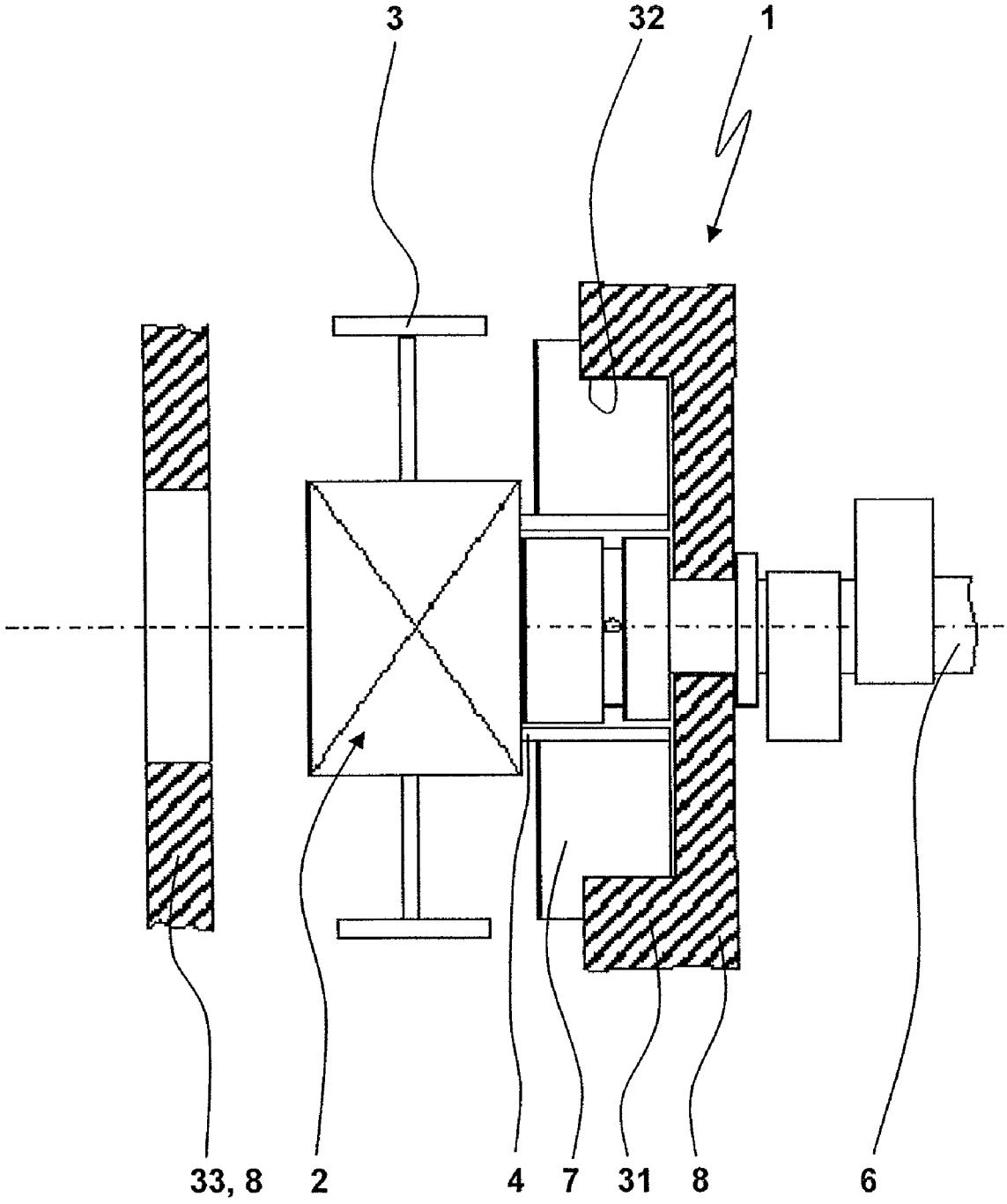
FIG. 3 is a view of a first embodiment of a camshaft adjuster, in which an actuating shaft and an electrical actuating assembly are arranged on the side of the variable ratio gear drive facing the camshaft.

For the embodiment of the invention shown in FIG. 3, the actuating shaft 4 and the actuating assembly 7 are arranged on the side of the variable ratio gear drive 2 facing the camshaft 6. The electrical actuating assembly 7 is supported on a wall 31 of the cylinder head 8. According to FIG. 3, the wall 8 has a recess 32, in which the actuating assembly 7 is integrated. The actuating assembly 7 and actuating shaft 4 are formed concentric to the camshaft 6, wherein the actuating shaft 4 is formed as a hollow shaft, which is passed through by the camshaft 6. The actuating shaft 4 is in drive connection, on one side, with a rotor of the actuating assembly 7 and feeds, on the other side, the drive movement of the actuating assembly 7 into the variable ratio gear drive 2 via a sealed recess, borehole, or opening arranged on the side of the variable ratio gear drive 2 facing the camshaft. The side of the variable ratio gear drive 2 facing away from the camshaft 6 can remain free, as shown in FIG. 3. Alternatively, on this side, via another recess from the housing of the variable ratio gear drive 2 and a shaft passing through this recess, another assembly, in particular, a vacuum pump, a fuel injection pump, an ignition distributor, or the like, can be driven, wherein the additional assembly can be supported on another housing wall 33 or a carrier, which is supported opposite the cylinder head 8.

Figure 4:
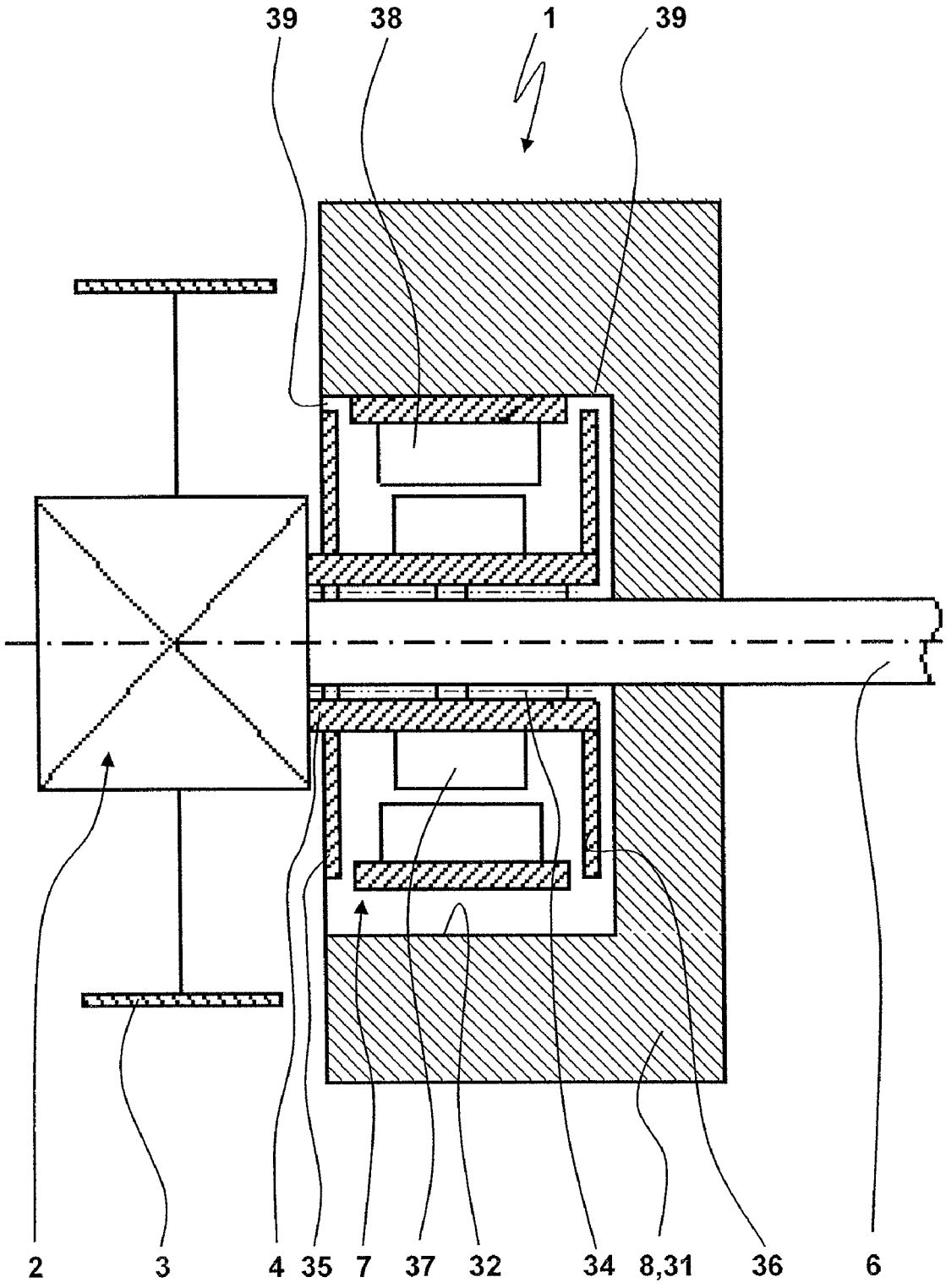
FIG. 4 is a view of another embodiment of a camshaft adjuster with an electrical actuating assembly, which is arranged on the side of the variable ratio gear drive facing the camshaft and which is supported by a bearing on the camshaft.

For the embodiment shown in FIG. 4, the camshaft 6 or a connection element locked in rotation with the camshaft has a cylindrical peripheral surface, which is used as a bearing surface for a bearing 34, in particular, one or more roller bearings lying one behind the other in the axial direction. The actuating shaft 4 formed as a hollow shaft is supported on the outside in the radial direction on the bearing 34. Advantageously, the variable ratio gear drive 2 is supported with the drive wheel 3 via the actuating shaft 4 by the bearing 34. Two disks 35, 36 limiting the actuating assembly 7 on the outside in the axial direction are locked in rotation with the actuating shaft 4. The actuating shaft 4 carries, on the outside in the radial direction, a rotor 37 of the actuating assembly 7, which is driven in a known way by a stator 38, which is supported against the cylinder head 8. To allow a rotational movement of the rotor 37 with the actuating shaft 4, between the cylinder head 8 and the ends of the plates 35, 36 on the outside in the radial direction, a radial gap 39 is formed. Undesired lubricant outside of the actuating assembly 7 is prevented from entering in the axial direction through the gap 39 into the interior of the actuating assembly 7 due to the centrifugal force caused by the rotating disks 35, 36.

For the shown support of the rotor 37 of the actuating assembly 7 on the camshaft 6, no relative movement occurs between the actuating shaft 4 and the camshaft 6, as long as there is no adjustment of the camshaft adjuster 1. This is advantageous in terms of energy, because no electrical energy must be applied for compensating the friction in the bearing 34, without adjustment taking place.

To form the assembly as simple as possible, advantageously the variable ratio gear drive 2 and the electrical actuating assembly 7 are constructed as a complete unit. This can be realized, for example, by a prolonged hollow cylinder-shaped actuating shaft 4, on which, in an end region, the rotor 37 is attached and which extends into the variable ratio gear drive 2. Furthermore, deviating from the embodiment shown in FIG. 4 it is possible that the stator 38 is also supported on the actuating shaft 4, while rotational locking between the stator 38 and cylinder head 8 is provided. Due to the arrangement of the bearing 34 directly on the camshaft, under some circumstances a small friction radius can be achieved. Furthermore, under some circumstances, the number of necessary bearings can be reduced, because it is possible that the actuating shaft 4 and rotor 37 are constructed without the intermediate connection of additional components.

Figure 5:
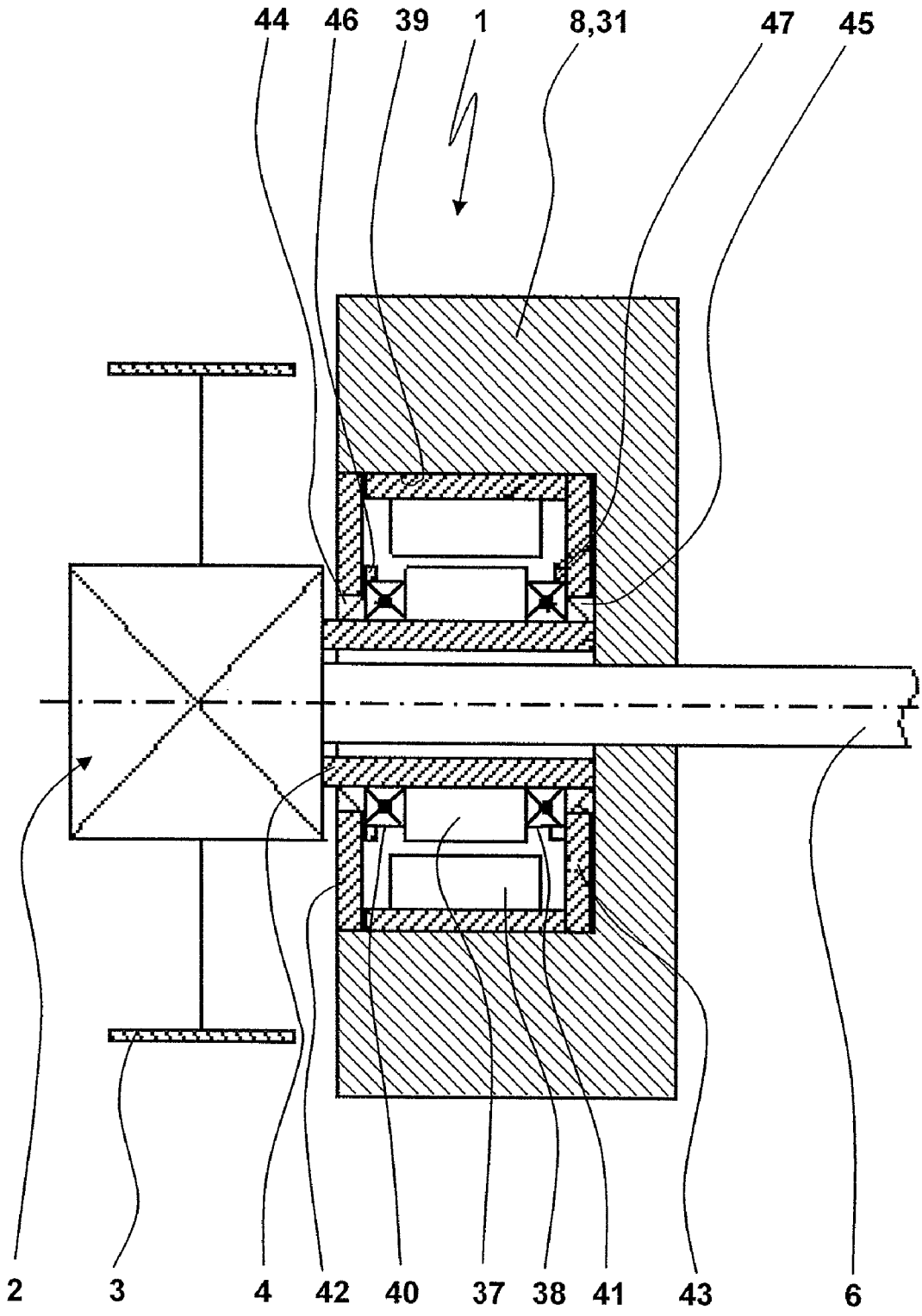
FIG. 5 is a view of another embodiment of a camshaft adjuster according to the invention, in which a rotor of an electrical actuating assembly is supported via a stator supported in a cylinder head.

Deviating from the previously described embodiment according to FIG. 4, for the embodiment shown in FIG. 5, the actuating shaft 4 is not supported by a bearing 34 on the camshaft 6. Instead, the actuating shaft 4 and via this measure, also the variable ratio gear drive 2 are supported with the drive wheel 3 via two bearings 40, 41 by disks 42, 43 relative to the cylinder head 8. The disks 42, 43 form, in the axial direction, closures of the actuating assembly 7 and are locked in rotation in the recess 39 of the cylinder head 8. The inner boreholes of the disks 42, 43 in the radial direction receive sealing elements 44, 45, which contact the actuating shaft 4 on the inside in the radial direction while sealing and guaranteeing a relative movement. The bearings 40, 41 are supported on the outside in the axial direction on a disk 42, 43 and also on the inside in the axial direction on the rotor 37. On the inside in the radial direction, the bearings 40, 41 are supported on the outer peripheral surface of the actuating shaft 4, while the bearings 40, 41 are supported on the outside in the radial direction on projections 46, 47 of the disks 42, 43. In addition to the shown indirect support of the rotor 37 by the disks 42, 43, a direct support using suitable receptacles in the cylinder head can also be realized. The embodiment shown in FIG. 5 represents a completely sealed construction, so that no lubricant of the internal combustion engine can penetrate into the interior of the actuating assembly 7. This construction therefore requires, under some circumstances, a permanent lubricant supply into the bearings 40, 41 or a seal with radial shaft seal rings or other seal elements, e.g., gap labyrinth seals. Under some circumstances, for a bearing of the rotor 37 in the cylinder head 8, bearings with an enlarged diameter are required in comparison with a bearing 34 relative to the camshaft. In this way, the number of roller bearings and the mass of rotating parts increase. Such a construction has the advantage that the position of the rotor 37 relative to the stator 38 is influenced merely by the production tolerances of the cylinder head 8 and the clearances of the bearings 40, 41. However, under some circumstances, the friction radius of the bearings 40, 41 also increases, by which the efficiency of the actuating assembly 7 is, under some circumstances, negatively influenced. Due to the increased mass of the rotating parts, under some circumstances, the moment of inertia can also be increased.

For a drive-fixed connection of components of the camshaft adjuster 1 according to the invention, for example, a drive connection between the rotor 37 and actuating shaft 4 and/or a coupling of the actuating shaft 4 with the allocated gear element of the variable ratio gear drive 2, advantageously radially small connection elements are to be selected. Possibilities here are, for example, a shaft-hub connection of the polygonal P4C type or polygon P3G type. Also conceivable is vulcanization of an elastic compensation element into the previously mentioned coupling regions. Alternatively or additionally, a magnetic coupling with or without an air gap can be used for a coupling. Here, a closed construction of the motor can be possible. Sliding of the magnetic coupling can be advantageous for one construction of an overload protection device. Under some circumstances, magnetization of the surrounding components and an increase in the costs and the inertia of masses is added, as well as the fact that metal particles can be attracted by such magnetization.

For solutions according to the invention, the actuating assemblies 7 are formed with a hollow driven shaft or actuating shaft 4, so that the camshaft 6 can be guided through the actuating assembly 7. The seal of the actuating shaft 4 relative to the surroundings in the cylinder head 8 or a shaft passing through the housing of the variable ratio gear drive 2 is of special importance for such a construction of the actuating assembly 7. For such seals, e.g., corresponding to the seals 44, 45, the following constructions can be possible:

- labyrinth seals,
- spiral-shaped surface topologies or elements, which feed the oil away from the inside of the actuating assembly 7,
- co-rotating, spinning sheets, which centrifuge lubricant away from functionally critical actuators via centrifugal force,
- a complete seal of the actuator, e.g., in the form of extrusion castings, wherein, in this case, the mechanical brake or drive power of the actuating assembly 7 can be transmitted by a magnetic coupling to the actuating shaft 4,
- a partial seal of functionally sensitive components, such as sensors, permanent magnets, windings.

The penetration of lubricant into the actuating assembly can be disadvantageous if iron particles are located in the lubricant, for example, due to abraded parts. These are attracted by a magnetic field of the actuating assembly 7 and thus, over the course of time, can increase an existing air gap or weaken a magnetic field.

While the actuating shaft 4, which is coupled directly with a gear element of the variable ratio gear drive 2, is constructed as a driven shaft of the actuating assembly 7 or is coupled with this assembly in a rotationally locked way or via a suitable coupling for the embodiments according to FIGS. 3 to 5, in the embodiments shown in FIGS. 6 to 10, a gear stage 49, which can create a gear ratio of 1, an up-conversion, or a down-conversion, is connected between the actuating shaft 4 and a driven shaft 48 of the actuating assembly 7.

Figure 6:
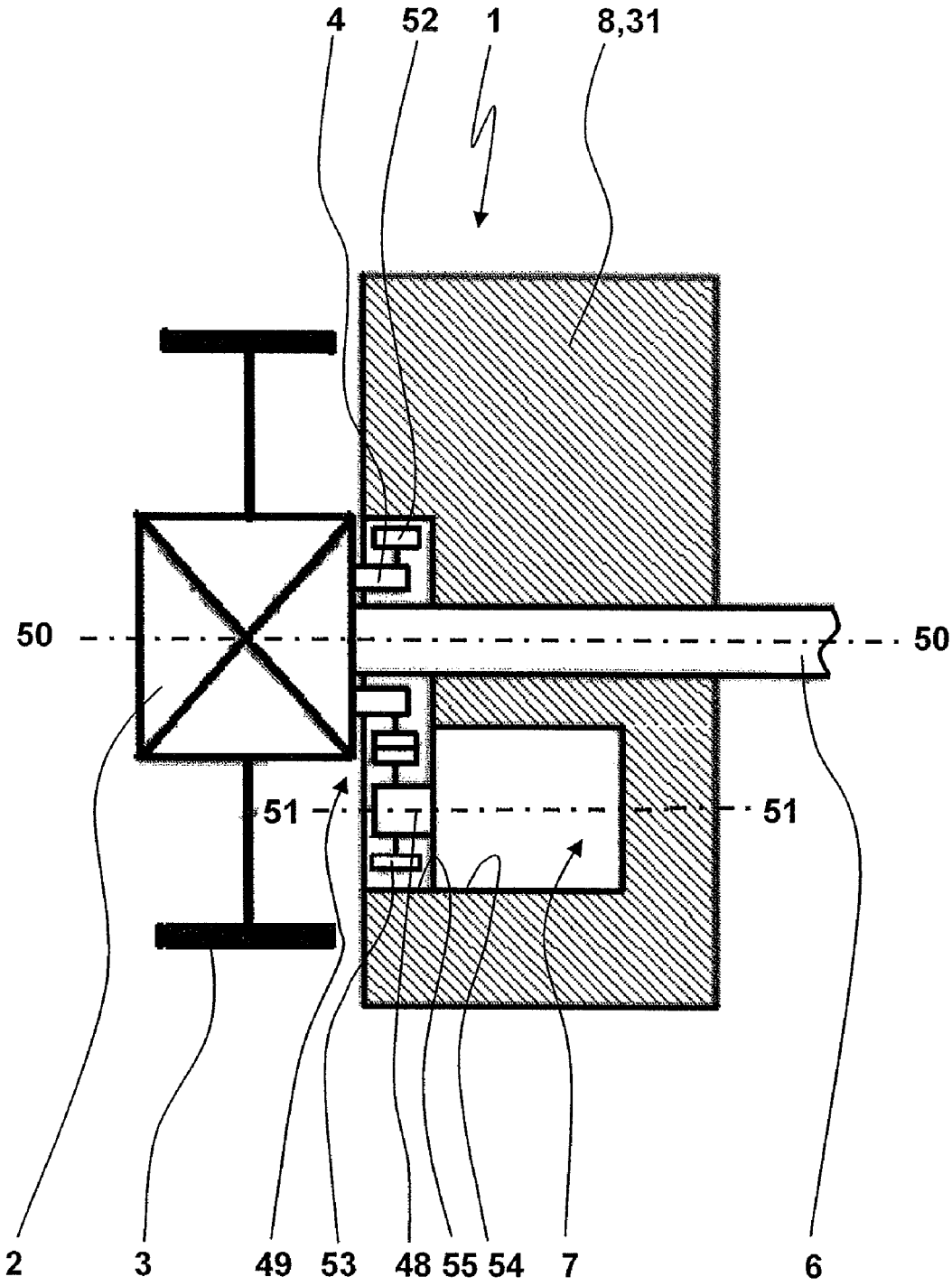
FIG. 6 is a view of another embodiment of a camshaft adjuster according to the invention, in which an electrical actuating assembly is arranged eccentric to a longitudinal axis of the camshaft and a gear stage connected between the actuating assembly and the variable ratio gear drive is integrated into the cylinder head.

For the embodiment shown in FIG. 6, a longitudinal axis 51-51 of the actuating assembly 7 is arranged parallel to a longitudinal axis 50-50 of the camshaft adjuster 1 and the camshaft 6. According to FIG. 6, the gear stage 49 is formed with two meshing spur wheels 52, 53, wherein the spur wheel 52 is locked in rotation on the end region of the actuating shaft 4 projecting from the variable ratio gear drive 2, while the driven shaft 48 of the actuating assembly 7 carries the spur wheel 53. The housing of the actuating assembly 7 is arranged in a first recess 54, wherein the driven shaft 48 is arranged on the side of the actuating assembly 7 on the variable ratio gear drive 2. The first recess 54 opens into another recess 55, in which the driven shaft 48, the allocated end region of the actuating shaft 4, the spur wheel 52, and also the spur wheel 53 are arranged. The recess 55 can be closed at the passage of the actuating shaft 4 and optional sealing with a cover in the direction of the variable ratio gear drive 2.

Figure 7:
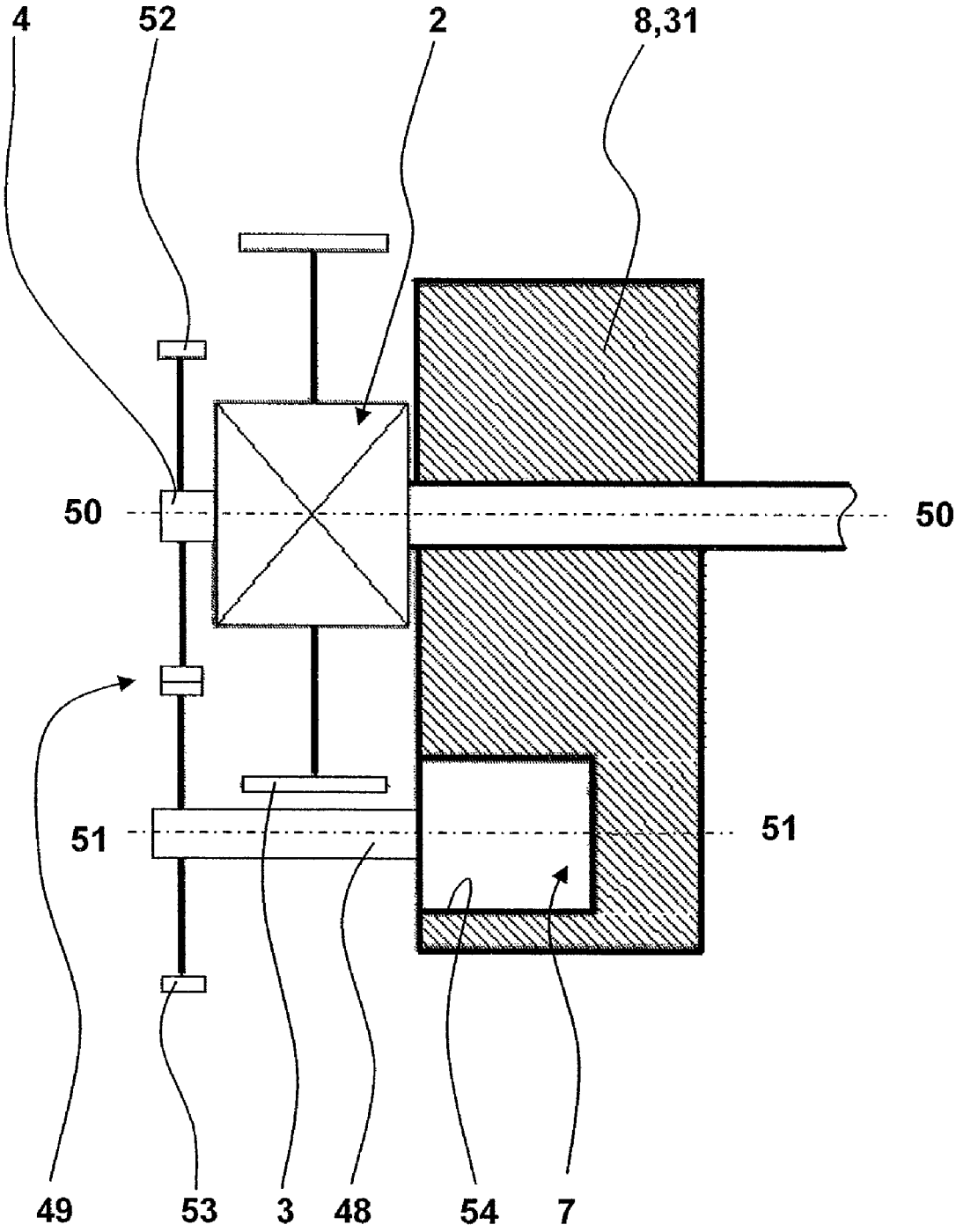
FIG. 7 is a view of another embodiment of a camshaft adjuster according to the invention, in which an electrical actuating assembly is arranged eccentric to a longitudinal axis of the camshaft and a gear stage, which is connected between the actuating assembly and variable ratio gear drive is arranged on the side of the variable ratio gear drive facing away from the camshaft.

For the embodiment shown in FIG. 7, in a construction corresponding to FIG. 6 in terms of the transmission of forces, the gear stage 49 and the actuating shaft 4 are arranged on the side of the variable ratio gear drive 2 facing away from the camshaft 6. This has the consequence that the driven shaft 48 of the actuating assembly 7 is lengthened such that this extends via the variable ratio gear drive 2 from the side facing the camshaft up to the side of the variable ratio gear drive 2 facing away from the camshaft 6. Under some circumstances, this requires an additional bearing of the support shaft, for example, in the end region of the driven shaft 48 facing away from the cylinder head 8. For the gear stage 49,

- a simple spur wheel stage, for example, under the use of economical injection-molded parts,
- a chain drive,
- a belt drive, or
- a flexible shaft according to DE 103 52 255 A1 can be used.

Figure 8:
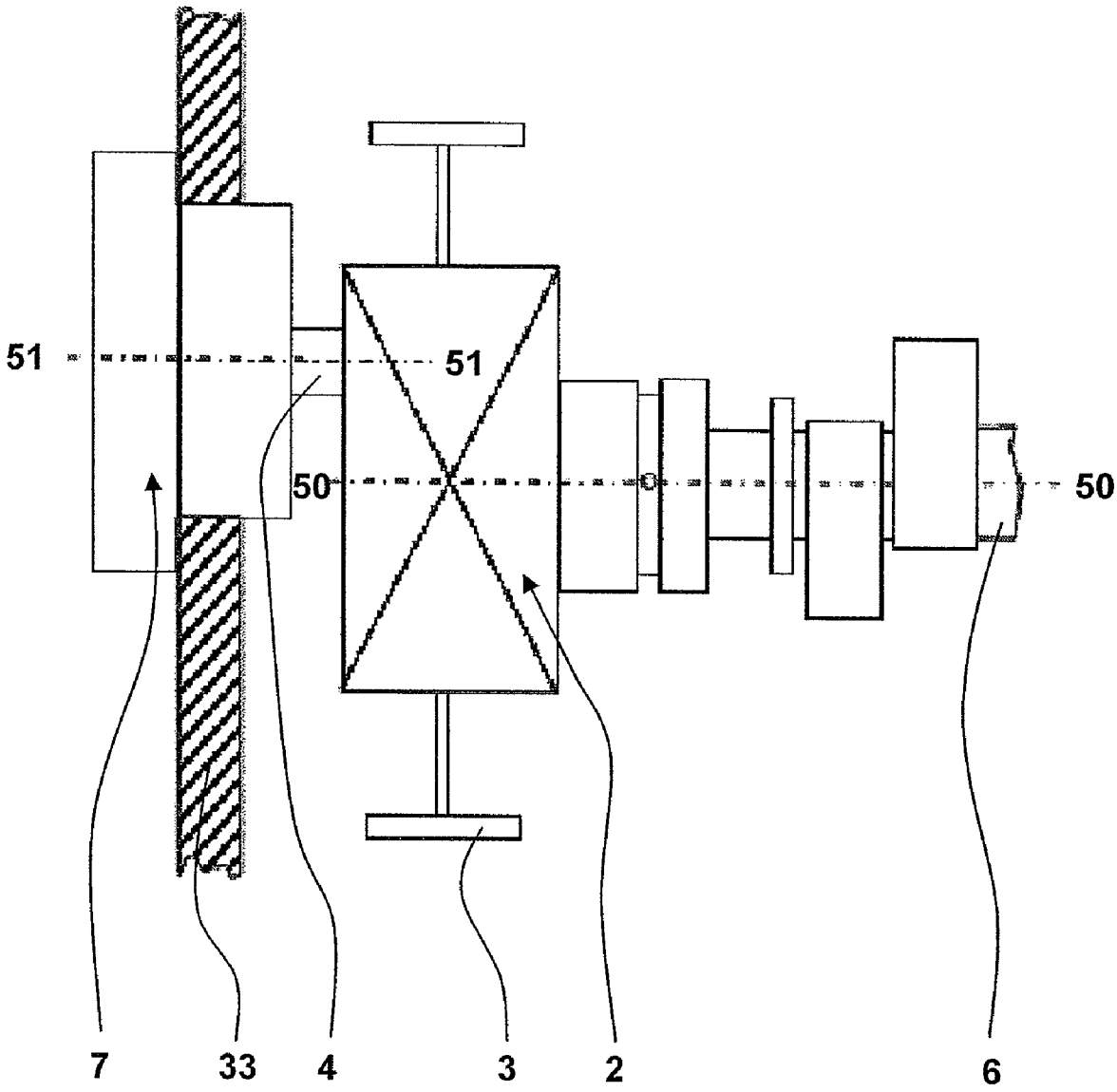
FIG. 8 is a view of another embodiment of a camshaft adjuster, in which feeding of the drive movement of the actuating assembly is realized on the side facing away from the camshaft and the longitudinal axis of the electrical actuating assembly is arranged eccentric to the longitudinal axis of the camshaft.

According to the embodiment shown in FIG. 8, the drive movement of the electric drive assembly 7 is transmitted to the side of the variable ratio gear drive 2 facing away from the camshaft. Here, the longitudinal axis 51-51 of the actuating assembly 7 is arranged parallel to the longitudinal axis 50-50 of the camshaft 6 and the variable ratio gear drive 2. For guaranteeing such an eccentric arrangement, under some circumstances, in the variable ratio gear drive 2 a gear stage 49 is used with an axle offset between the drive shaft and driven shaft. The electrical actuating assembly 7 is supported in this case on a wall 33 of the cylinder head 8.

Figure 9:
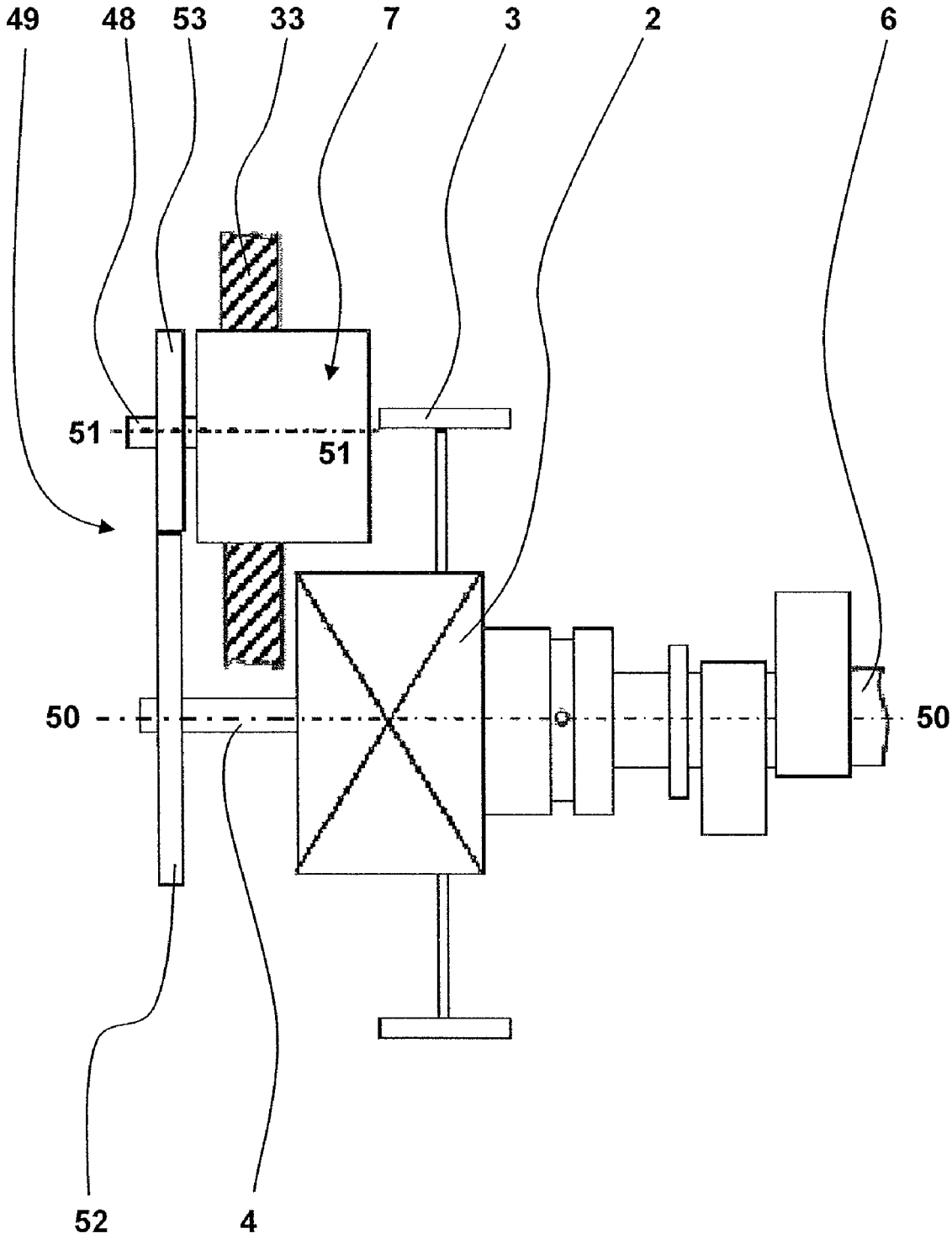
FIG. 9 is a view of another embodiment of a camshaft adjuster, for which the actuating assembly is arranged on the side of the variable ratio gear drive facing away from the camshaft and its drive movement is transmitted into the variable ratio gear drive via an intermediate gear stage.

For the embodiment shown in FIG. 9, the actuating assembly 7 is arranged on the side of the variable ratio gear drive 2 facing away from the camshaft 6, here, under partial axial overlapping, wherein the driven shaft 48 of the actuating assembly 7 points away from the camshaft 6 and the longitudinal axes 50-50 and 51-51 are arranged parallel to each other. On the side of the wall 33 facing away from the camshaft 6 there is the gear stage 49, by which the actuating shaft 4 guided through the wall 33 and a recess of the housing of the variable ratio gear drive 2 to the side facing away from the camshaft is driven.

Figure 10:
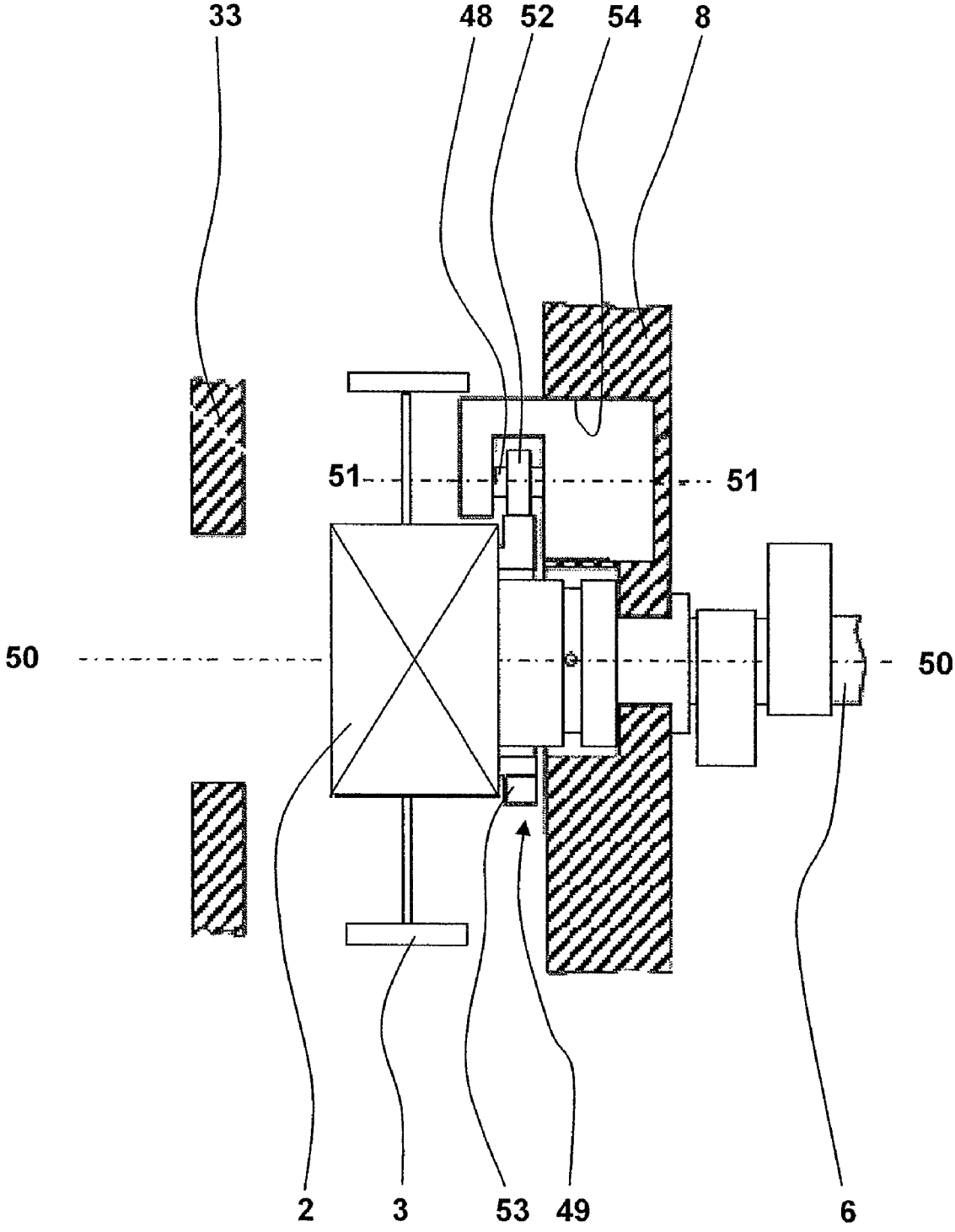
FIG. 10 is a view of another embodiment of a camshaft adjuster according to the invention, in which the electrical actuating assembly is integrated into the cylinder head on the side of the variable ratio gear drive facing the camshaft, the longitudinal side of the electrical actuating assembly is arranged eccentric to the longitudinal axis of the camshaft under intermediate connection of a gear stage and the driven shaft of the electrical actuating assembly is supported by a carrier in its end region.

FIG. 10 shows another embodiment, which corresponds essentially to the embodiment shown in FIG. 6 in terms of the transmission of forces and the gear stage 49 that is used. However, in this case a gear stage 49 is arranged outside of the cylinder head 8 and only the recess 54 is provided in the cylinder head 8, wherein this recess partially receives a housing of the actuating assembly 7. The housing of the actuating assembly 7 has a U-shaped longitudinal section, wherein the driven shaft 48 of the actuating assembly 7 is supported in the region of the two side legs of the U and the spur wheel 52 is arranged on the driven shaft 48 between these side legs.

Figure 11:
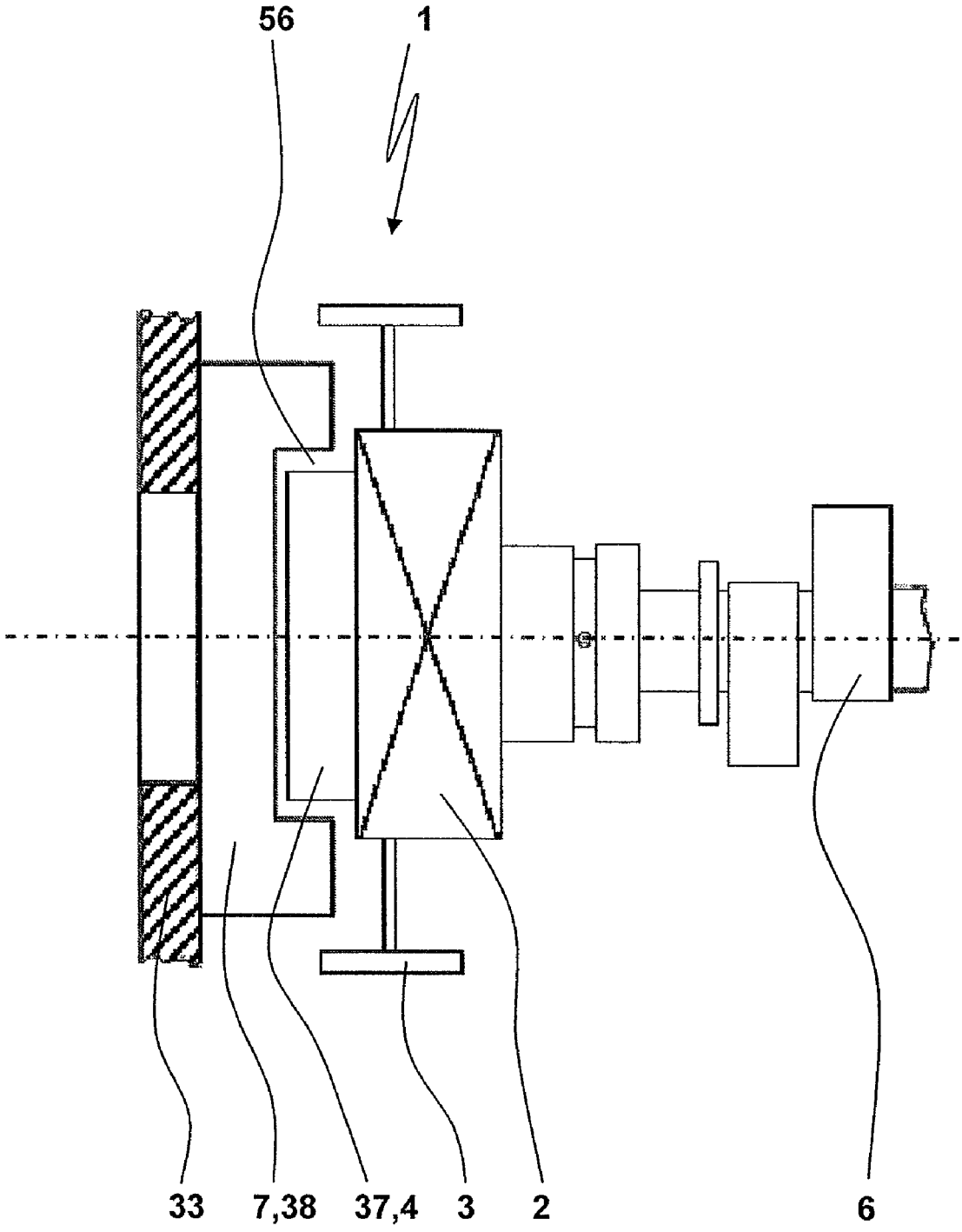
FIG. 11 is a view of another embodiment of a camshaft adjuster, in which interlocking is provided between the electrical actuating assembly and the variable ratio gear drive.

It is further proposed to construct the actuating assembly 7, the variable ratio gear drive 2, and the actuating shaft 4 in an interconnected way and/or to join the functional units of both components with each other:

For example, according to the embodiment shown in FIG. 11, the rotor 37 can be constructed integrally with the actuating shaft 4, while, as a separate component, the actuating assembly 7, which is supported on the opposing wall 33 and which is coupled with the rotor 37 via the air gap 56, has only the stator 38, that is, for example, a suitable brake or motor winding.

Figure 12:
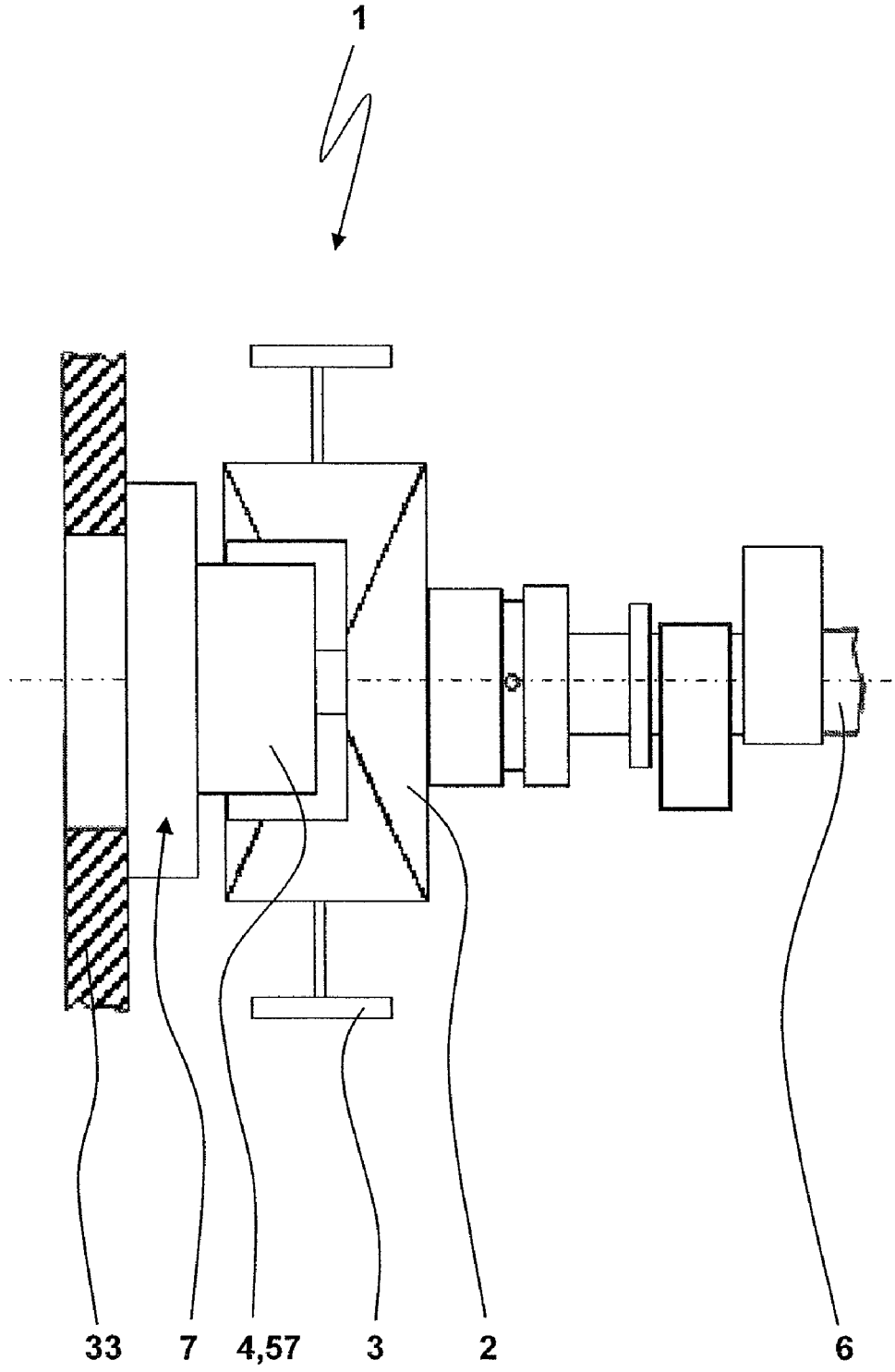
FIG. 12 is a view of another embodiment of a camshaft adjuster, in which interlocking is provided between the electrical actuating assembly and the variable ratio gear drive.

It is also possible, as shown in FIG. 12, that the driven shaft 48 of the actuating assembly 7 already has a shaft or a gear element 57 of the variable ratio gear drive 2. It is further possible that the entire variable ratio gear drive 2 is integrated into the electrical actuating assembly 7 with a common housing. A common use of housing parts and/or components for supporting and/or transmitting power is also possible.

The electrical actuating assembly 7 can be formed as a drive unit or as a brake. In addition to the use of an electrical actuating assembly, an arbitrary actuating assembly, for example, a hydromotor, can be used, which acts as a drive assembly and/or as a brake assembly.

LIST OF REFERENCE SYMBOLS

1 Camshaft adjuster
2 Variable ratio gear drive
3 Drive wheel
4 Actuating shaft
5 Driven shaft
6 Camshaft
7 Actuating assembly
8 Cylinder head
9 Housing
10 Seal element
11 Seal element
12 Coupling
13 Eccentric shaft
14 Bearing element
15 Wobble plate
16 Hollow shaft
17 Bearing element
18 Driven conical wheel
19 Bearing
20 Drive conical wheel
21 Longitudinal axis
22 Central screw
23 Lubricating position
24 Lubricating position
25 Feed recess
26 Flow channel
27 Flow channel
28 Peripheral surface
29 Peripheral surface
30 Borehole
31 Wall
32 Recess
33 Housing wall
34 Bearing
35 Disk
36 Disk
37 Rotor
38 Stator
39 Clearance
40 Bearing
41 Bearing
42 Disk
43 Disk
44 Seal element
45 Seal element
46 Projection
47 Projection
48 Driven shaft
49 Gear stage
50 Longitudinal axis
51 Longitudinal axis
52 Spur wheel
53 Spur wheel
54 Recess
55 Recess
56 Air gap
57 Gear element

The invention claimed is:

1. Camshaft adjuster for an internal combustion engine comprising a variable ratio gear drive with three gear elements, of which one of the gear elements is allocated to each of a camshaft, a drive wheel, and an actuating assembly, wherein the actuating assembly is located between the variable ratio gear drive and part of the camshaft and includes a stator, a rotor located inside the stator, the rotor is connected to an actuating shaft arranged coaxial to the camshaft that extends from the actuating assembly to the variable ratio gear drive.

2. Camshaft adjuster according to claim 1, wherein the actuating assembly is integrated into a wall of a cylinder head of the internal combustion engine.

3. Camshaft adjuster according to claim 1, wherein the camshaft is guided through the actuating assembly.

4. Camshaft adjuster according to claim 3, wherein components of the actuating assembly are supported on the camshaft.

5. Camshaft adjuster according to claim 3, wherein the rotor of the actuating assembly and also the stator of the actuating assembly are supported by an end wall of a cylinder head.

6. Camshaft adjuster according to claim 1, wherein the actuating assembly and the gear element allocated thereto are coupled with each other via a polygonal-shaft-hub connection.

7. Camshaft adjuster according to claim 1, wherein the actuating assembly and the gear element allocated thereto are coupled with each other by vulcanized, elastic compensation elements.

8. Camshaft adjuster according to claim 1, wherein the actuating shaft is a hollow shaft that is concentric to an end of the camshaft.

9. Camshaft adjuster according to claim 8, wherein the actuating shaft is supported by a bearing located on the camshaft.

10. Camshaft adjuster according to claim 8, wherein the actuating shaft is supported by bearings located in disks connected to a cylinder head that are concentric to an end of the camshaft.

11. Camshaft adjuster for an internal combustion engine comprising a variable ratio gear drive with three gear elements, of which one of the gear elements is allocated to each of a camshaft, a drive wheel, and an actuating assembly, wherein the actuating assembly is located in a position between the variable ratio gear drive and a front of the engine in an area of the camshaft and includes a stator, a rotor located inside the stator, the rotor is connected to a driven shaft arranged parallel to the camshaft, and an auxiliary gear stage is located between the driven shaft and an actuating shaft of the variable ratio gear drive.

12. Camshaft adjuster according to claim 11, wherein the auxiliary gear stage comprises a spur wheel connected to the actuating shaft that meshes with a second spur wheel connected to the actuating shaft.

13. Camshaft adjuster according to claim 12, wherein the second spur wheel and the actuating shaft are coaxial with the camshaft.

14. Camshaft adjuster according to claim 11, wherein the auxiliary gear stage comprises a chain drive, a belt drive or a flexible shaft.

* * * * *